US007652417B2

(12) United States Patent
Yotani et al.

(10) Patent No.: US 7,652,417 B2
(45) Date of Patent: Jan. 26, 2010

(54) FLAT PANEL DISPLAY

(75) Inventors: Junko Yotani, Mie (JP); Sashiro Uemura, Mie (JP)

(73) Assignee: Noritake Co., Ltd., Aichi (JP)

( * ) Notice: Subject to any disclaimer, the term of this patent is extended or adjusted under 35 U.S.C. 154(b) by 317 days.

(21) Appl. No.: 11/436,678

(22) Filed: May 17, 2006

(65) Prior Publication Data

US 2006/0261322 A1 Nov. 23, 2006

(30) Foreign Application Priority Data

May 19, 2005 (JP) ..... 2005/146449

(51) Int. Cl.
*H01J 1/62* (2006.01)

(52) U.S. Cl. ..... 313/497; 313/495; 313/496

(58) Field of Classification Search ..... 313/306, 313/308–310, 351, 355, 495–497; 445/49–51; 3/306, 308–310, 351, 355, 495–497
See application file for complete search history.

(56) References Cited

U.S. PATENT DOCUMENTS

2002/0017875 A1* 2/2002 Lee et al. ..... 315/169.1
2002/0185951 A1* 12/2002 Russ et al. ..... 313/310
2003/0184214 A1* 10/2003 Lee et al. ..... 313/497
2004/0046493 A1* 3/2004 Lee et al. ..... 313/497
2004/0090163 A1* 5/2004 Russ et al. ..... 313/309
2004/0130258 A1* 7/2004 Oh ..... 313/495
2004/0222732 A1 11/2004 Lee et al.
2005/0116600 A1* 6/2005 Chi et al. ..... 313/293
2005/0231089 A1* 10/2005 Chen et al. ..... 313/303
2005/0231090 A1* 10/2005 Chen et al. ..... 313/303
2005/0231098 A1* 10/2005 Chen et al. ..... 313/495
2005/0248256 A1* 11/2005 Song et al. ..... 313/495

FOREIGN PATENT DOCUMENTS

JP 2001-167720 A 6/2001
JP 2002-343281 A 11/2002
JP 2003-308797 A 10/2003
JP 2004-193038 A 7/2004

* cited by examiner

*Primary Examiner*—Bumsuk Won
(74) *Attorney, Agent, or Firm*—Blakely, Sokoloff, Taylor & Zafman LLP

(57) ABSTRACT

A cathode substrate (10) and gate substrate (30) are arranged such that at least gate ribs (12) abut against cathode ribs (34) and gate electrodes (35) and, depending on the case, the cathode ribs (34) abut against cathodes (13). The gate ribs (12) and cathode ribs (34) can be formed to heights of about 5 μm to 300 μm. The gate ribs (12) can be surface-polished so their heights are uniform. The distance between the cathode electrodes (13) and gate electrodes (35) can accordingly be made uniform and short, so driving at a low voltage and an increase in luminance uniformity can be realized.

5 Claims, 5 Drawing Sheets

FLAT PANEL DISPLAY

BACKGROUND OF THE INVENTION

The present invention relates to a flat panel display and, more particularly, to a field emission type flat panel display.

In recent years, as a flat panel display such as an FED (Field Emission Display) or a flat vacuum fluorescent display in which electrons emitted from an electron-emitting source serving as a cathode bombard a light-emitting portion formed of phosphors on a counterelectrode to emit light, various types that use nanotube fibers, e.g., carbon nanotubes or carbon nanofibers, as the electron-emitting source have been proposed (for example, see Japanese Patent Laid-Open Nos. 2002-343281 and 2004-193038). FIG. 9 is a partially exploded view showing an example of a conventional flat panel display which uses nanotube fibers as electron-emitting sources.

This flat panel display has a cathode substrate 100 having a substrate 101 made of glass or the like, an anode substrate 200 having an at least partially transmitting front glass 201, and a gate substrate 300 which is disposed substantially parallel to the substrate 101 and front glass 201. The substrate 101 of the cathode substrate 100 and the front glass 201 of the anode substrate 200 are arranged to oppose each other through a frame-like spacer glass (not shown) and are adhered to the spacer glass with low-melting frit glass to form an envelope. The interior of the envelope is maintained at a vacuum degree on the order of $10^{-5}$ Pa.

The cathode substrate 100 has the substrate 101 and a plurality of substrate ribs 102 which vertically extend on that surface of the substrate 101 which opposes the gate substrate 300 at a predetermined interval to be parallel to each other. Cathode electrodes 103 which substantially form matrices when seen from the top and which are obtained by fixing electron-emitting sources made of nanotube fibers such as carbon nanotubes or carbon nanofibers to the surfaces of metal members such as 42-6 alloy members are disposed on those regions of the substrate 101 which are sandwiched by the substrate ribs 102.

The anode substrate 200 has the front glass 201, a plurality of black matrices 202 which have rectangular sections and are formed on that surface of the front glass 201 which opposes the gate substrate 300 at a predetermined interval to form stripes in a direction parallel to the substrate ribs 102, red-, green- and blue-emitting phosphor films 203R, 203G, and 203B which are formed on those regions of the front glass 201 which are sandwiched by the black matrices 202, metal-backed films 204 which are formed on regions sandwiched by the phosphor films 203R, 203G, and 203B to serve as anodes, and a plurality of front ribs 205 which are formed on the black matrices 202 and have rectangular sections.

The gate substrate 300 disposed in the envelope comprises a glass plate 301, a flat electrode 302 which is formed on the surface of the glass plate 301 on the anode substrate 200 side, band-like gate electrodes 303 formed on the surface of the glass plate 301 on the cathode substrate 100 side to correspond to the phosphor films 203R, 203G, and 203B, and an insulating layer 304 which is formed on the gate electrodes 303. The gate substrate 300 has electron-passing holes 305, substantially circular when seen from the top, which are formed at regions where the band-like gate electrodes 303 and matrix-like cathode electrodes 103 overlap, to extend through the flat electrode 302, glass plate 301, gate electrodes 303, and insulating layer 304. Each electron-passing hole 305 forms a pixel of the flat panel display. The gate substrate 300 is sandwiched by the substrate ribs 102 of the cathode substrate 100 and the front ribs 205 of the anode substrate 200.

In this flat panel display, when a predetermined potential difference is applied between the gate substrate 300 and cathode electrodes 103 such that the gate substrate 300 side has a positive potential, electrons extracted from those regions of the cathode electrodes 103 which intersect the gate electrodes 303 are emitted from the electron-passing holes 305.

More specifically, first, a voltage is applied to the flat electrode 302 to set it to have a higher potential than that of the cathode electrodes 103, and an electric field is applied to the surfaces of the cathode electrodes 103 in advance. When a voltage is further applied to the gate electrodes 303 to set them to have a higher potential than that of the cathode electrodes 103, an electric field is applied to the cathode electrodes 103 from the outer surfaces of the gate electrodes 303 which form the electron-passing holes 305, to extract electrons from electron-emitting sources 111 disposed on the surfaces of the cathode electrodes 103. The electrons are accelerated by the flat electrode 302 to which a voltage has been applied to set it to have a positive potential with respect to the gate electrodes 303, and emitted from the electron-passing holes 305 to the front glass 201 side.

If a potential (accelerating voltage) higher than that of the flat electrode 302 is applied to the metal-backed films 204, the electrons emitted from the electron-passing holes 305 are accelerated toward the metal-backed films 204, and penetrate through the metal-backed films 204 to bombard the phosphor films 203G, 203B, and 203R. Thus, the phosphor films emit light.

A method of manufacturing such a flat panel display will be described.

The cathode substrate 100 is formed in the following manner. First, an insulating paste such as a vitreous paste is printed on the substrate 101 with a known printing method such as screen printing to form the substrate ribs 102 on one surface of the substrate 101. Subsequently, the cathode electrodes 103 with electron-emitting surfaces disposed on their surfaces are disposed on those regions of the substrate 101 which are sandwiched by the substrate ribs 102. This forms the cathode substrate 100. The cathode electrodes 103 described above can be formed by disposing the electron-emitting sources on their surfaces by CVD or the like.

The anode substrate 200 is formed in the following manner. First, the front glass 201 is prepared. An insulating paste such as a vitreous paste is printed on the front glass 201 with a known printing method such as screen printing to form the black matrices 202 on one surface of the front glass 201. Subsequently, the phosphor materials of the phosphor films 203R, 203G, and 203B are printed on the front glass with a known printing method such as screen printing to form the red-, green-, and blue-emitting phosphor films 203R, 203G, and 203G on those regions on the front glass 201 which are sandwiched by the black matrices 202. Then, the metal-backed films 204 are formed on the phosphor films 203R, 203G, and 203B with a known deposition method. Finally, a glass paste is repeatedly printed on the black matrices 202 with a known printing method such as screen printing to form the front ribs 205. Alternatively, the front ribs 205 may be formed by fixing members made of glass or a ceramic material formed into predetermined shapes to the black matrices 202 by adhesion using a frit paste, or by contact bonding using metal films.

The gate substrate 300 is formed in the following manner. First, the glass plate 301 is prepared, and the flat electrode 302 is formed on its one surface by printing or sputtering. Subsequently, the band-like gate electrodes 303 are formed on the other surface of the glass plate 301 by printing or sputtering. The insulating layer 304 is then formed on the other surface of the glass plate 301 by printing or photolithography to cover the gate electrodes 303. Finally, the electron-passing holes 305 are formed by sandblasting to extend through the flat electrode 302, glass plate 301, gate electrodes 303, and insulating layer 304.

When the cathode substrate 100, anode substrate 200, and gate substrate 300 formed in the above manner are assembled, a flat panel display is formed. More specifically, first, the gate substrate 300 is sandwiched with the substrate ribs 102 of the cathode substrate 100 and the front ribs 205 of the anode substrate 200. In this state, the rim of the substrate 101 of the cathode substrate 100 and the rim of the front glass 201 of the anode substrate 200 are adhered to frame-like spacer glass with low-melting frit glass to form an envelope. The interior of the envelope is vacuum-evacuated to form the flat panel display. In this flat panel display, the gate substrate 300 is fixed and held by the anode substrate 200 and gate substrate 300 by pressurization with an atmospheric pressure.

In the flat panel display as described above, in order to improve the luminance uniformity, it is important that the distance between the cathode electrodes 103 of the cathode substrate 100 and the gate electrodes 303 of the gate substrate 300 is uniform at any location. In order to realize driving at a low voltage, it is necessary to decrease the distance between the cathode electrodes 103 and gate electrodes 303. For these purposes, conventionally, as described above, the insulating layer 304 is formed by printing or photolithography, or a thin glass plate which is formed thin to have a uniform thickness in advance is used as the insulating layer 304, so the distance between the cathode electrodes 103 and gate electrodes 303 becomes uniform and short.

When printing or photolithography as described above is employed, it is difficult to form a uniformly thin, crack-free layer as the insulating layer 304. It is also difficult to form the insulating layer 304 so as not to attach to the side walls of the electron-passing holes 305 or the like. When using a thin glass plate as the insulating layer 304, if the glass plate is excessively thin, it tends to break, and accordingly the thickness and size of the glass plate are limited. Therefore, in the conventional flat panel display, it is difficult to uniform and decrease the distance between the cathode electrodes and gate electrodes.

SUMMARY OF THE INVENTION

It is an object of the present invention to provide a flat panel display in which the distance between the cathode electrodes and gate electrodes can be uniformed and decreased.

In order to solve the problems as described above, according to the present invention, there is provided a flat panel display characterized by comprising a vacuum envelope having an at least partially transparent front glass and a substrate arranged to oppose the front glass, a cathode electrode having an electron-emitting source and arranged on the substrate, a gate electrode structure having an electron-passing hole and arranged between the front glass and the substrate, a phosphor film and anode which are stacked on the front glass, and a plurality of support members which are formed with the same height on a surface of the substrate which opposes the gate electrode structure and support the gate electrode structure.

In the above flat panel display, the support members may extend in one direction along a surface of the substrate and be formed to be spaced apart from each other by a predetermined distance.

The above flat panel display may further comprise a plurality of first members which are formed on a surface of the gate electrode structure which opposes the substrate and are interposed between the substrate and the gate electrode structure, wherein the support members may be combined in gaps of the first members. The first members may extend in another direction perpendicular to one direction. At this time, the first member may be divided into a plurality of members. With this arrangement, the support members may be combined in gaps of the divided first members.

DESCRIPTION OF THE PREFERRED EMBODIMENTS

Figure 1:
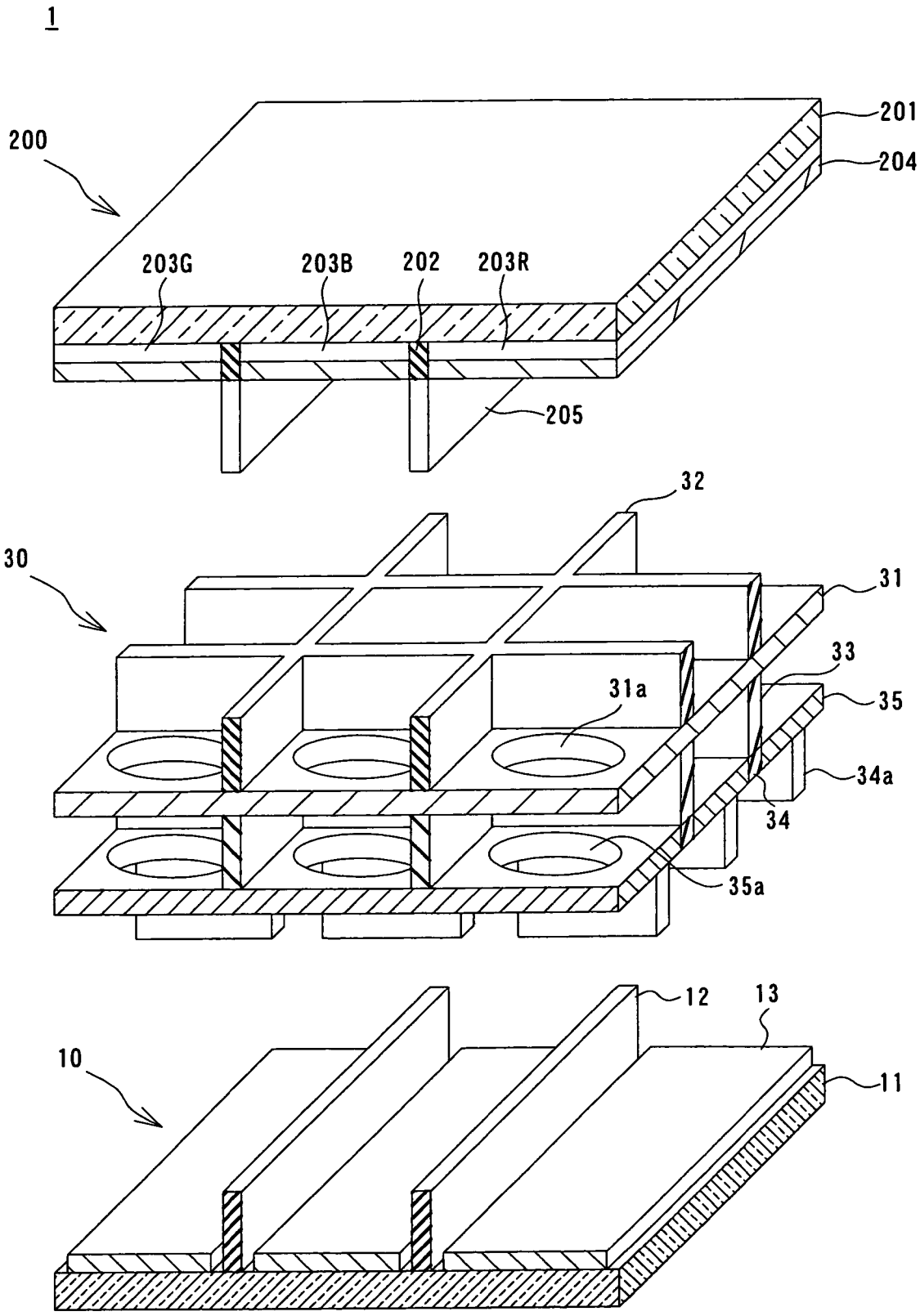
FIG. 1 is an exploded perspective view showing the arrangement of a flat panel display according to an embodiment.

An embodiment of the present invention will be described in detail with reference to the accompanying drawings. FIG. 1 is an exploded perspective view showing the arrangement of a flat panel display according to this embodiment. The characteristic feature of the flat panel display according to this embodiment resides in the cathode substrate and gate substrate. Therefore, the constituent elements that are identical to those of the conventional flat panel display described in Background of Invention have the same names and are denoted by the same reference numerals, and a description thereof will be omitted when appropriate.

A flat panel display 1 according to this embodiment has a cathode substrate 10 having a substrate 11 made of glass or the like, an anode substrate 200 having at least partially transparent front glass 201, and a gate substrate 30 which is disposed to be substantially parallel to the substrate 11 and front glass 201. The substrate 11 of the cathode substrate 10 and the front glass 201 of the anode substrate 200 are arranged to oppose each other through a frame-like spacer glass (not shown) and are adhered to the spacer glass with low-melting frit glass to form an envelope. The interior of the envelope is maintained at a vacuum degree on the order of $10^{-5}$ Pa. In the following description, when looking at FIG. 1 from the front, the vertical direction will be defined as the direction of height, the direction of depth will be defined as the vertical direction, and the left-to-right direction will be defined as the horizontal direction. In the direction of height, the anode substrate 200 side will be defined as the upper side and the cathode substrate 10 side will be defined as the lower side.

The cathode substrate 10 has the substrate 11 and a plurality of substrate ribs 12 (support members) which vertically extend on that surface of the substrate 11 which opposes the gate substrate 30 (gate electrode structure) at a predetermined interval to be parallel to each other. On those regions of the substrate 11 which are sandwiched by the substrate ribs 12, rod- or plate-shaped cathode electrodes 13 which are obtained by fixing electron-emitting sources made of nanotube fibers such as carbon nanotubes or carbon nanofibers to the surfaces of metal members such 42-6 alloy members are disposed. The upper surfaces of the cathode electrodes 13 are lower than those of the substrate ribs 12. As long as the cathode electrodes 13 are formed on the regions sandwiched by the substrate ribs 12, the shapes of the cathode electrodes 13 are not limited to the rod or plate shapes described above, but can be set appropriately and freely, e.g., to form a substantially matrix shape when seen from the top described in Background of the Invention.

The anode substrate 200 has the front glass 201, a plurality of black matrices 202 which have rectangular sections and formed on that surface of the front glass 201 which opposes the gate substrate 30 at a predetermined interval to form stripes in a direction parallel to the substrate ribs 12, red-, green-, and blue-emitting phosphor films 203R, 203G, and 203B which are formed on those regions of the front glass 201 which are sandwiched by the black matrices 202, metal-backed films 204 which are formed on regions sandwiched by the phosphor films 203R, 203G, and 203B to serve as anodes, and a plurality of front ribs 205 which vertically extend on the black matrices 202 at a predetermined interval and have rectangular sections.

The front ribs 205 form rods or plates which are very thin as compared to their lengths. Such front ribs 205 are made of a material having a small secondary electron emission ratio in consideration of secondary electron emission from the front ribs 205, or a slightly conductive material so the front ribs 205 will not accumulate electrons. For example, one of NP-7800 series (manufactured by Noritake Kizai K.K.) such as NP-7833 or 7834E can be used.

The gate substrate 30 disposed in the envelope comprises a flat electrode 31 which serves as a field control electrode, an anode rib 32 which is formed on the upper surface of the flat electrode 31 and substantially forms a matrix when seen from the top, an intermediate rib 33 which is formed on the lower surface of the flat electrode 31 and substantially forms a matrix when seen from the top, cathode ribs 34 which are formed on the lower surface of the intermediate rib 33 in a direction perpendicular to the substrate ribs 12 of the cathode substrate 10, and gate electrodes 35 which are disposed on those regions on the lower surface of the intermediate rib 33 which are sandwiched by the cathode ribs 34.

The flat electrode 31 is made of a conductor and has the shape of a substantially rectangular plate when seen from the top. The flat electrode 31 has a plurality of through holes 31*a* which are substantially circular when seen from the top and are spaced apart from each other at a predetermined distance in the longitudinal and horizontal directions. The flat electrode 31 protects the cathode electrodes 13 and gate electrodes 35 from the influence of an electric field generated by the anodes. Hence, the flat electrode 31 can prevent an electric field from being generated by the potential difference between the metal-backed films 204 serving as the anodes and the gate electrodes 35, and can prevent abnormal electrical discharge between the cathode electrodes 13 and metal-backed films 204, thereby preventing leaking light. Note that the shapes of the through holes 31*a* are not limited to substantially circular shapes when seen from the top, but can be set appropriately and freely, e.g., elliptic shapes or rectangular shapes.

The anode rib 32 is made of an insulating material and has a matrix shape in which plate- or rod-shaped members are combined perpendicularly in the vertical and horizontal directions. Such an anode rib 32 is formed on the upper surface of the flat electrode 31 such that the through holes 31*a* of the flat electrode 31 are located at the gaps of the matrix.

The intermediate rib 33 is made of an insulating material and has a matrix shape in which plate- or rod-shaped members are combined perpendicularly in the vertical and horizontal directions. Such an intermediate rib 33 is formed on the lower surface of the flat electrode 31 such that the through holes 31*a* of the flat electrode 31 are located at the gaps of the matrix.

Each cathode rib 34 is made of an insulating material and has a plate- or rod-like shape as a whole. A plurality of projections 34*a* (first members) are formed on the surfaces of the cathode ribs 34 on the cathode substrate 10 side to be spaced apart from each other by a predetermined distance in the longitudinal direction of the cathode ribs 34. The projections 34*a* have prismatic shapes such as plates or rods, and their lengths in the longitudinal direction are equal to or smaller than the distance between the adjacent substrate ribs 12 on the cathode substrate 1. The distance between the adjacent projections 34*a* is set equal to or larger than the width of each substrate rib 12. The projections 34*a* are formed such that they are not located on the intersection points of the matrix of the intermediate rib 33 or anode rib 32 when seen from the direction of height. Such cathode ribs 34 are disposed on the lower surface of the intermediate rib 33 along either one direction (horizontal direction in FIG. 1) of the vertical and horizontal directions. Thus, each cathode rib 34 is disposed parallel to its adjacent cathode rib 34 to be spaced apart from it by a predetermined distance.

The gate electrodes 35 are made of a conductor and have substantially rectangular plate-like shapes, e.g., strips, when seen from the top. A plurality of through holes 35*a* are formed in each gate electrode 35 to be spaced apart from each other by a predetermined distance in the longitudinal direction. The through holes 35*a* are formed with the same pitches as those of the through holes 31*a* of the flat electrode 31. Such gate electrodes 35 are disposed on those regions of the lower surface of the intermediate rib 33 which are sandwiched by the cathode ribs 34. At this time, the through holes 35*a* are disposed to overlap the through holes 31*a* of the flat electrode 31 when seen from the direction of height. The diameters of the through holes 35*a* are desirably larger than those of the through holes 31*a* when considering electron convergence or the like.

Figure 2A:
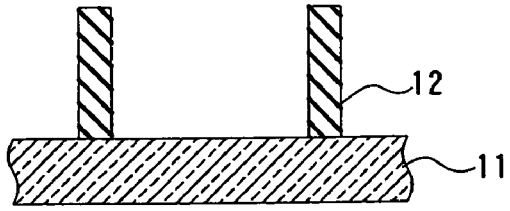
FIGS. 2A and 2B are schematic views showing a method of manufacturing a cathode substrate 10.

A method of manufacturing the cathode substrate 10 will be described with reference to FIGS. 2A and 2B. First, using a predetermined mask pattern, an insulating paste such as a vitreous paste (e.g., NP-7833 or NP-7834E manufactured by Noritake Kizai K.K.) is repeatedly printed on the substrate 11 made of glass or the like with a known printing method such as screen printing to a predetermined height, more specifically, to a height that corresponds to the desired distance between the cathode electrodes 13 and gate electrodes 35, and is calcined. This forms the substrate ribs 12 as shown in FIG. 2A. The substrate ribs 12 can be formed sufficiently short, more specifically, to a height of about 5 μm to 300 μm. The substrate ribs 12 have sufficient strength when compared to that of the thin glass plate which is employed in the conventional insulating layer 304.

Subsequently, the substrate ribs 12 are polished by a grindstone, sandpaper, or the like. Hence, all the substrate ribs 12 can have the uniform height at any location.

Figure 2B:
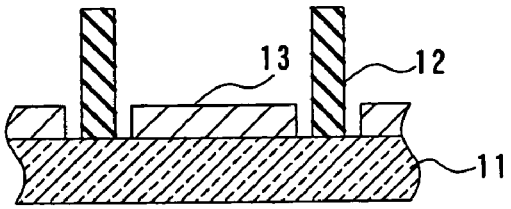
Figure 3A:
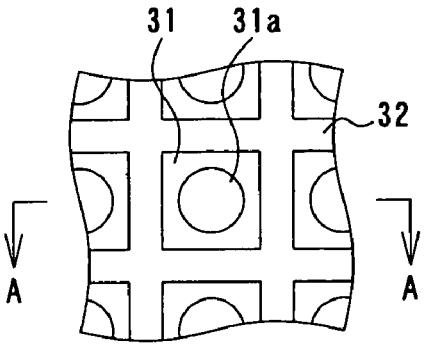
FIG. 3A is a plan view showing a method of manufacturing a gate substrate 30.
Figure 3B:
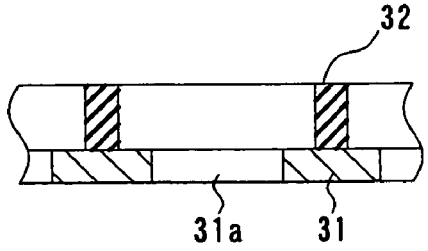
FIG. 3B is a sectional view taken along the line A-A of FIG. 3A.
Figure 4A:
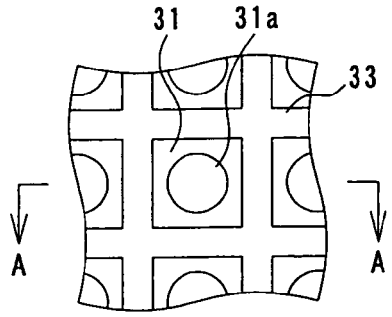
FIG. 4A is a plan view showing the method of manufacturing the gate substrate 30.
Figure 4B:
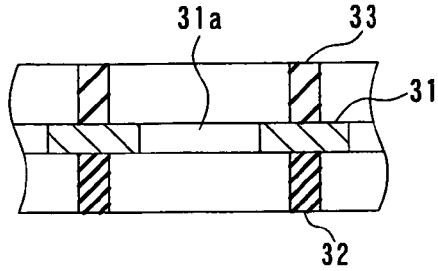
FIG. 4B is a sectional view taken along the line A-A of FIG. 4A.

Subsequently, as shown in FIG. 2B, the cathode electrodes 13 with the electron-emitting sources being disposed on their surfaces by CVD or the like are disposed on those regions of the substrate 11 which are sandwiched by the substrate ribs 12. Note that the width of each cathode electrode is desirably equal or smaller than the interval of the substrate ribs 12. The cathode substrate 10 is produced with the above steps.

A method of manufacturing the gate substrate 30 will be described with reference to FIGS. 3A and 3B to FIGS. 6A and 6B. First, the flat electrode 31 is prepared. The plurality of through holes 31*a* which are substantially circular when seen from the top are formed in the flat electrode 31 in advance with a known etching method such as wet etching, dry etching, or electric field etching so as to be spaced apart from each other by predetermined distances in the vertical and horizontal directions.

Subsequently, using a predetermined mask pattern, an insulating paste such as a vitreous paste (e.g., NP-7833 or NP-7834E manufactured by Noritake Kizai K.K.) is repeatedly printed on the flat electrode 31 with a known printing method such as screen printing to a predetermined height, and is calcined. This forms the anode rib 32, which substantially forms a matrix when seen from the top, on the flat electrode 31. At this time, the anode rib 32 is formed on the flat electrode 31 such that the through holes 31*a* of the flat electrode 31 are located at the gaps of the matrix. The anode rib 32 can be printed not only by the printing method described above but by sandblasting or etching.

Subsequently, using a predetermined mask pattern, an insulating paste such as a vitreous paste (e.g., NP-7833 or NP-7834E manufactured by Noritake Kizai K.K.) is repeatedly printed on that surface of the flat electrode 31 where the anode rib 32 is not formed, that is, on the lower surface of the flat electrode 31 with a known printing method such as screen printing to a predetermined height, and is calcined. This forms the intermediate rib 33, which substantially forms a matrix when seen from the top, on the lower surface of the flat electrode 31. At this time, the intermediate rib 33 is formed on the flat electrode 31 such that the through holes 31*a* of the flat electrode 31 are located at the gaps of the matrix. Accordingly, the anode rib 32 and intermediate rib 33 are formed to overlap each other when seen from the direction of height.

Figure 5A:
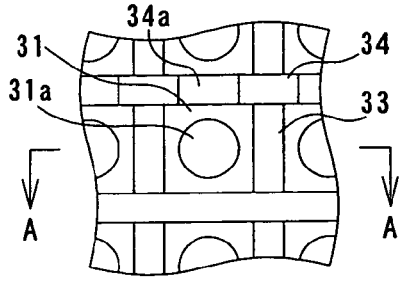
FIG. 5A is a plan view showing the method of manufacturing the gate substrate 30.
Figure 5B:
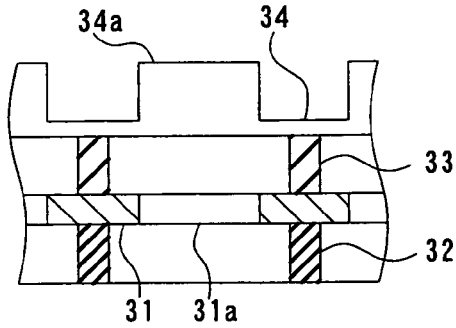
FIG. 5B is a sectional view taken along the line A-A of FIG. 5A.

Subsequently, using a predetermined mask pattern, an insulating paste such as a vitreous paste (e.g., NP-7833 or NP-7834E manufactured by Noritake Kizai K.K.) is repeatedly printed on the intermediate rib 33 with a known printing method such as screen printing to a predetermined height, more specifically, to a height equal to or less than the height of the substrate ribs 12, and is calcined. This forms the cathode ribs 34 on those members of the intermediate rib 33 along either one of the vertical and horizontal directions, as shown in FIGS. 5A and 5B. The cathode ribs 34 are formed to a thickness of about 5 μm to 300 μm at the projections 34*a*, and to a thickness almost equal to the thickness of the gate electrodes 35 at portions other than the projections 34*a*. In this manner, the projections 34*a* can be formed sufficiently short, i.e., 5 μm to 300 μm. The cathode ribs 34 have sufficient strength when compared to the thin glass plate employed in the conventional insulating layer 304.

Figure 6A:
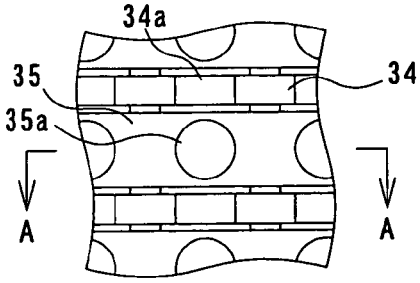
FIG. 6A is a plan view showing the method of manufacturing the gate substrate 30.
Figure 6B:
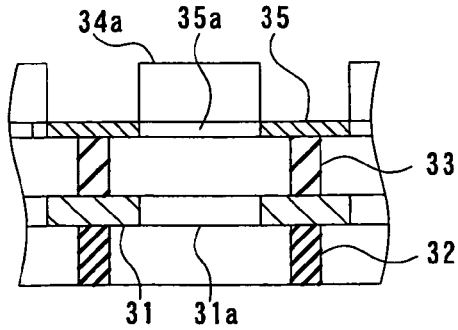
FIG. 6B is a sectional view taken along the line A-A of FIG. 6A.

Subsequently, as shown in FIGS. 6A and 6B, the gate electrodes 35 formed into predetermined shapes in advance are disposed on those regions of the intermediate rib 33 which are sandwiched by the cathode ribs 34. At this time, the gate electrodes 35 are disposed such that the through holes 35*a* overlap the through holes 31*a* of the flat electrode 31 when seen from the direction of height. Alternatively, each gate electrode 35 may be positioned by adhering its one end in the longitudinal direction on the intermediate rib 33 with frit glass or the like. The gate substrate 30 is produced with the above steps.

Figure 7A:
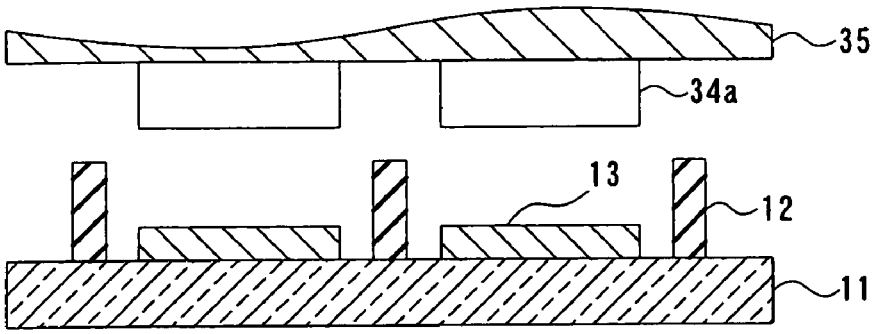
FIG. 7A is a sectional view of the main part before assembly of a flat panel display according to this embodiment.
Figure 7B:
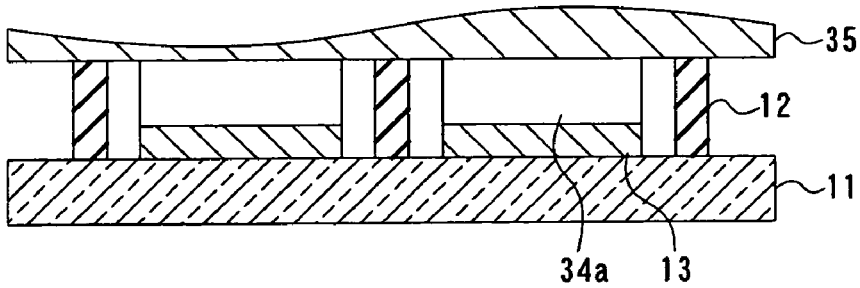
FIG. 7B is a sectional view showing the main part after the assembly.

A method of assembling the flat panel display 1 according to this embodiment described above with reference to FIGS. 7A and 7B. FIG. 7A is a sectional view of the main part before assembly of the flat panel display according to this embodiment, and FIG. 7B is a sectional view of the main part after the assembly. When assembling the flat panel display 1 according to this embodiment, first, as shown in FIG. 7A, that surface of the cathode substrate 10 where the substrate ribs 12 are formed is set to oppose that surface of the gate substrate 30 where the cathode ribs 34 are formed. At this time, when the substrate ribs 12 and cathode ribs 34 are seen from the direction of height, the longitudinal direction of the substrate ribs 12 is perpendicular to that of the cathode ribs 34, and the substrate ribs 12 are set to oppose those portions of the cathode ribs 34 where the projections 34*a* are not provided.

In the state shown in FIG. 7A, the gate substrate 30 is sandwiched by the substrate ribs 12 of the cathode substrate 10 and the front ribs 205 of the anode substrate 200, and the rim of the substrate 11 of the cathode substrate 10 and the rim of the front glass 201 of the anode substrate 200 are adhered to the frame-like spacer glass with low-melting frit glass to form an envelope. The interior of the envelope is vacuum-evacuated to form the flat panel display 1.

At this time, the cathode substrate 10 and anode substrate 200 are pressed into the vacuum envelope by the atmospheric pressure, so the cathode substrate 10 and gate substrate 30 are disposed such that at last the substrate ribs 12 are in contact or in tight contact with the cathode ribs 34 and gate electrodes 35. Depending on the case, the projections 34*a* of the cathode ribs 34 which are interposed between the cathode substrate 10 and gate substrate 30 are also in contact or in tight contact with the cathode electrodes 13. In these states, the substrate ribs 12, or the substrate ribs 12 and projections 34*a*, are held at predetermined distances from each other as they are sandwiched by the cathode substrate 10 and gate substrate 30. Accordingly, the distance between the cathode electrodes 13 and gate electrodes 35 depends on the height of the substrate ribs 12, or the heights of the substrate ribs 12 and projections 34*a*. As described above, the substrate ribs 12 and projections 34*a* can be formed sufficiently low to about 5 μm to 300 μm. Therefore, the distance between the cathode electrodes 13 and gate electrodes 35 can be decreased, so the flat panel display 1 according to this embodiment can achieve driving at a low voltage.

When the surfaces of the substrate ribs 12 are polished, the heights of the substrate ribs 12 can be uniformed. Therefore, in the flat panel display 1 according to this embodiment, since the distance between the cathode electrodes 13 and gate electrodes 35 is maintained uniform at any location, its luminance can be uniformed, and its area can be increased.

The projections 34*a* come into contact or into tight contact with the cathode substrate 10 to evenly press the cathode substrate 10 and gate substrate 30 together with the substrate ribs 12, so as to maintain the distance between the cathode electrodes 13 and gate electrodes 35 uniform. When the projections 34*a* are provided in this manner, the pressure acting on the substrate ribs 12 is decentralized to further improve the resistance against the influence of the atmospheric pressure.

Therefore, not only the luminance is uniformed, but also a much larger area can be obtained.

As shown in FIG. 7B, the cathode substrate 10 and gate substrate 30 are combined to sandwich the substrate ribs 12 with the projections 34*a* of the cathode ribs 34. This can facilitate alignment of the cathode substrate 10 and gate substrate 30. Thus, not only the operation is simplified but also a high quality can be achieved.

According to this embodiment, the intermediate rib 33 which substantially forms a matrix when seen from the top is arranged between the flat electrode 31 and gate electrodes 35. This decreases the distance from the through holes 35*a* in the gate electrodes 35 to the insulator between the flat electrode 31 and gate electrodes 35. Therefore, secondary electron emission from the insulator upon irradiation with electron beams can be suppressed.

Figure 8:
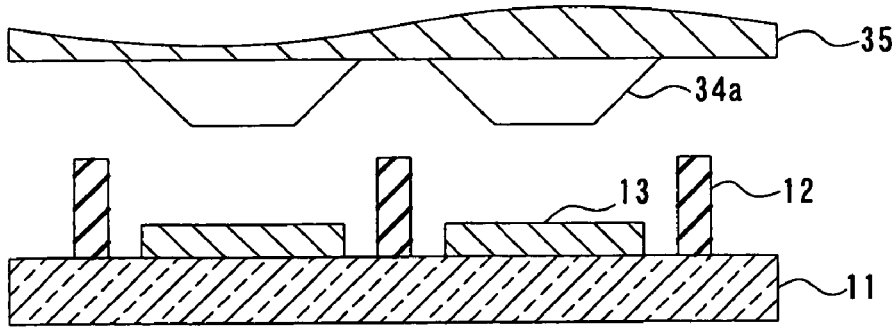
FIG. 8 is a schematic view showing a modification of cathode ribs 34.
Figure 9:
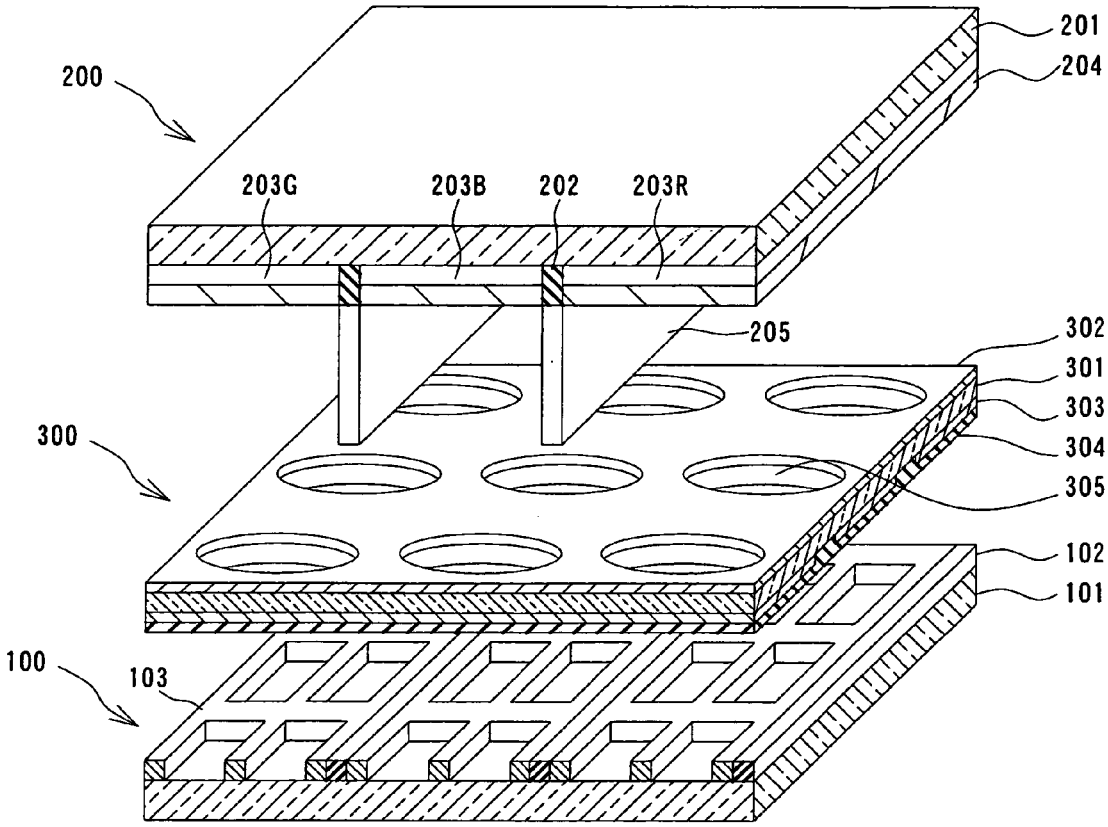
Fig. 9 PRIOR ART
FIG. 9 is a partially exploded view showing an example of a conventional flat panel display in which nanotube fibers are used as electron-emitting sources.

According to this embodiment, the projections 34*a* of the cathode ribs 34 have prismatic shapes such as rods or plates. Alternatively, the projections 34*a* may have frustopyramidal shapes projecting toward the cathode substrate 10, as shown in FIG. 8. In this case, the side surfaces of the projections 34*a* form inclined surfaces. When aligning the cathode substrate 10 with the gate substrate 30, even if the substrate ribs 12 come into contact with the side surfaces of the projections 34*a*, as the side surfaces of the projections 34*a* form inclined surfaces, the substrate ribs 12 shift to the correct positions along the inclined surfaces. Therefore, the cathode substrate 10 and gate substrate 30 can be aligned more readily.

According to this embodiment, the substrate ribs 12 have the shape of rods or plates extending in a predetermined direction. However, the shapes of the substrate ribs 12 are not limited to them, but can be set appropriately and freely, e.g., columnar shapes, as far as their heights are uniform. Furthermore, when the substrate ribs 12 have columnar shapes, the substrate ribs 12 may be freely disposed at desired position to form, e.g., a dot matrix. Then, the substrate ribs 12 can be concentratedly provided to, e.g., locations that must be reinforced due to the structure of the flat panel display. As a result, the area of the flat panel display can increase.

According to this embodiment, the projections 34*a* of the cathode ribs 34 are provided at predetermined pitches. The position to provide the projections 34*a* can be set appropriately and freely. Then, the projections 34*a* can be concentratedly provided to, e.g., locations that must be reinforced due to the structure of the flat panel display. As a result, the area of the flat panel display can increase.

As has been described above, according to the present invention, the support members are formed on that surface of the substrate which opposes the gate electrode structure, so the support members can be formed with uniform and small heights. When the support members abut against the gate electrode structure, by the distance between the cathode electrodes and gate electrodes can be maintained uniform and short. As a result, the luminance can be uniformed, and driving at a low voltage is realized.

What is claimed is:

1. A flat panel display comprising:

a vacuum envelope having an at least partially transparent front glass (201) and a substrate (11) arranged to oppose said front glass;

a cathode electrode (13) having an electron-emitting source and arranged on said substrate, said electron-emitting source being formed of carbon nanotubes fibers;

a gate electrode structure (30) having an electron-passing hole and arranged between said front glass and said substrate, wherein said gate electrode structure comprises a flat electrode (31) having an electron passing hole (31*a*) and serving as an electric field control electrode, a grid-like intermediate rib (33) formed on said flat electrode on a surface thereof opposite said substrate, and a plurality of stripe-shaped gate electrodes (35) provided on said intermediate rib;

phosphor film layers (203G, 203B, 20R) and an anode layer (204) which are laminated on said front glass;

a plurality of support members (12) which are formed on said substrate on a surface thereof opposite said gate electrode structure substantially to an equal height and in parallel at predetermined intervals with each other, said plurality of support members abutting against said plurality of gate electrodes to support said gate electrode structure; and a plurality of projections (34A) formed on said gate electrodes on surfaces thereof opposite said substrate in a direction perpendicular to said plurality of support members and substantially parallel at predetermined intervals with each other;

wherein said support members and said projections are engaged such that said support members each are interposed between any two adjacent said projections to be put and held therebetween.

2. The flat panel display defined by claim 1 wherein said projections have prismatic shapes.

3. The flat panel display defined by claim 1 wherein said projections have a vertical length equal to or smaller than the distance between adjacent support members.

4. The flat panel display defined by claim 1 wherein a distance between adjacent projections is equal to or larger than a width of each said support member.

5. A flat panel display according to claim 1, further comprising:

a plurality of front ribs (205) formed on said front glass on a surface thereof opposite said substrate substantially to an equal height and in parallel at predetermined intervals with each other; and a gridlike anode rib (32) formed on said flat electrode on a surface thereof opposite said front glass;

wherein said front rib and said anode rib are stacked one on the other to fulfill a spacer function as a whole.

* * * * *